US010744388B2

(12) United States Patent
Martikainen

(10) Patent No.: US 10,744,388 B2
(45) Date of Patent: Aug. 18, 2020

(54) GOLF AIDE WITH TACTILE INDICATOR

(71) Applicant: Lime Hook Oy, Helsinki (FI)

(72) Inventor: Janne Martikainen, Helsinki (FI)

(73) Assignee: Lime Hook Oy, Helsinki (FI)

( * ) Notice: Subject to any disclaimer, the term of this patent is extended or adjusted under 35 U.S.C. 154(b) by 0 days.

(21) Appl. No.: 16/303,219

(22) PCT Filed: May 24, 2016

(86) PCT No.: PCT/FI2016/050352
§ 371 (c)(1),
(2) Date: Nov. 20, 2018

(87) PCT Pub. No.: WO2017/203091
PCT Pub. Date: Nov. 30, 2017

(65) Prior Publication Data
US 2019/0201769 A1 Jul. 4, 2019

(51) Int. Cl.
*A63B 69/36* (2006.01)
*A63B 69/00* (2006.01)
(Continued)

(52) U.S. Cl.
CPC ..... *A63B 69/3623* (2013.01); *A63B 15/00* (2013.01); *A63B 60/34* (2015.10);
(Continued)

(58) Field of Classification Search
CPC ..... A63B 69/3623; A63B 2102/32; A63B 71/0622; A63B 69/36; A63B 24/0062;
(Continued)

(56) References Cited

U.S. PATENT DOCUMENTS 4,249,762 A 2/1981 Richards
5,316,306 A 5/1994 Cody
(Continued)

FOREIGN PATENT DOCUMENTS

DE 202013001474 U1 3/2013
GB 2387785 A 10/2003
(Continued)

OTHER PUBLICATIONS

Search report of PCT/FI2016/050352 issued by Finnish Patent Office dated Sep. 12, 2016.
(Continued)

*Primary Examiner* — Nini F Legesse
(74) *Attorney, Agent, or Firm* — Berggren LLP

(57) ABSTRACT

A golf aide is described for providing tactile feedback to a user during a golf swing. The golf aide has a shaft (12) with a golf grip (11), an arm (14) having a linking element (13) coupling the arm (14) to the shaft (12) at a first end of the arm (14), and a tactile indicator (15) arranged at a distal end of the arm (14) opposite the linking element (13). The tactile indicator has a width greater than a width of the arm and the shaft (12), arm (14) and tactile indicator (15) are fixedly arrangeable such that the distance and angle between a portion of the golf grip to be gripped during a golf stroke and the tactile indicator is equivalent to a predetermined target distance and angle between hands and a lateral upper arm portion of an inside arm of a user at an apex of a backswing of a golf stroke.

20 Claims, 6 Drawing Sheets

(51) Int. Cl.

| | |
|---|---|
| ***A63B 15/00*** | (2006.01) |
| ***A63B 60/42*** | (2015.01) |
| ***A63B 60/34*** | (2015.01) |
| *A63B 71/06* | (2006.01) |
| *A63B 60/48* | (2015.01) |
| *A63B 60/46* | (2015.01) |
| *A63B 60/00* | (2015.01) |
| *A63B 60/10* | (2015.01) |
| *A63B 43/02* | (2006.01) |
| *A63B 102/32* | (2015.01) |

(52) U.S. Cl.
CPC ..... *A63B 60/42* (2015.10); *A63B 69/0059* (2013.01); *A63B 43/02* (2013.01); *A63B 60/10* (2015.10); *A63B 60/46* (2015.10); *A63B 60/48* (2015.10); *A63B 71/0619* (2013.01); *A63B 2060/0081* (2015.10); *A63B 2060/0085* (2015.10); *A63B 2071/0655* (2013.01); *A63B 2071/0694* (2013.01); *A63B 2102/32* (2015.10); *A63B 2220/44* (2013.01); *A63B 2220/51* (2013.01); *A63B 2220/56* (2013.01); *A63B 2225/09* (2013.01)

(58) Field of Classification Search
CPC ..... A63B 2071/0655; A63B 69/0002; A63B 2069/0008; A63B 69/00; A63B 2220/13; A63B 69/3608
USPC ..... 473/219, 232, 242, 256, 257
See application file for complete search history.

(56) References Cited

U.S. PATENT DOCUMENTS

| | | | | |
|---|---|---|---|---|
| 5,599,021 | A * | 2/1997 | Lary | A63B 15/00 473/219 |
| 6,547,672 | B1 | 4/2003 | Chough | |
| 7,056,222 | B2 * | 6/2006 | Skelley | A63B 24/0003 473/219 |
| 2002/0094879 | A1 | 7/2002 | Dawson | |
| 2003/0190971 | A1 | 10/2003 | Rohan-Weaver | |
| 2008/0109975 | A1 | 5/2008 | Park | |
| 2011/0201459 | A1 | 8/2011 | Lundeen | |
| 2012/0088641 | A1 | 4/2012 | Shah | |

FOREIGN PATENT DOCUMENTS

| | | | |
|---|---|---|---|
| KR | 101372576 | B1 | 3/2014 |
| WO | 2016041003 | A1 | 3/2016 |

OTHER PUBLICATIONS

Search report of the European application No. 169030152.2 issued by European Patent Office dated Oct. 1, 2019 (4 pages).

* cited by examiner

GOLF AIDE WITH TACTILE INDICATOR

PRIORITY

This application is a U.S national application of the international application number PCT/FI2016/050352 filed on May. 24, 2016 the contents of which are incorporated herein by reference.

FIELD OF THE INVENTION

The present invention relates generally to a golf aide. In particular, to a golf aide with a tactile indicator for providing tactile feedback during at least a portion of a golf swing.

BACKGROUND OF THE INVENTION

For centuries golfers have been looking for ways to improve their golf swings. Many golf aides exist and many have a very specific purpose to address or train a specific issue.

For example, there are golf aides which are essentially a regular golf club with modifications made thereto. One example is a golf club which has angled hinges incorporated into the shaft. The purpose of said aide is that if a swing is not proper, the improper forces on the club shaft will cause the hinges in the shaft to move and the user will receive the feedback of the shaft breaking during their swing.

Additionally, there are golf aides which can be added to a golf club such as weights on or near the head of the golf club to help build and train necessary muscle groups.

Still yet, there are golf aides which are completely separate from golf clubs as a whole. For example, there are hoops which are circular and oriented in the plane of a proper golf swing. A user can stand inside the hoop with a golf club and swing along the path of the hoop, thereby training the proper plane of the swing.

However, most of these golf aides have several flaws. For one, any golf aide with a full golf club or needing a full golf club can rarely be used indoors in a home or office environment. Additionally, very few existing golf aides provide tactile feedback to a user where a user can immediately feel, during a swing, if the swing is proper and if it isn't, how the swing can be adjusted.

Many players who receive golf instruction from a pro will receive this type of tactile feedback from the pro during practice. For example, the pro can stop the golfer at the apex of their back swing and physically adjust the positioning of the players hands or body so the player can feel the proper positioning. However, without a pro to give the proper tactile feedback, most players are left to guess if what they are doing is correct or simply rely on imperfect visual feedback, such as by using a video recorder.

The present invention looks to address at least some of the issues present in current golf learning by providing a golf aide which has a tactile indicator capable of providing tactile feedback during a golf swing The small portable size and ease of use makes t possible to use the golf aide anywhere when the golfer has a free moment, in the office, at home etc.

SUMMARY OF THE INVENTION

It is an aspect of the invention to provide a golf aide for providing tactile feedback to a user during a golf swing. Example locations during the swing where tactile feedback is to be provided is in the back swing, for example at the apex of the back swing and/or in the slot, or at the follow through, for example at the completion of the swing.

The golf aide has a shaft (12) with a golf grip (11), an arm (14) having a linking element (13) coupling the arm (14) to the shaft (12) at a first end of the arm (14), and a tactile indicator (15) arranged at a distal end of the arm (14) opposite the linking element (13).

The tactile indicator can have a width greater than a width of the arm and/or the shaft. Additionally, the width of the tactile indicatior may be only greater than a portion of the arm and/or shaft.

The shaft (12), arm (14) and tactile indicator (15) can be fixedly arrangeable such that the distance and angle between a portion of the golf grip to be gripped during a golf stroke, for example the middle of the left palm of a right handed golfer, and the tactile indicator is equivalent to a predetermined target distance and angle between hands, for example the middle of the left palm of a right handed golfer, and a lateral upper arm portion of an inside arm of a user at an apex of a backswing of a golf stroke.

The golf aide can also be used to give visual feedback to a user and/or tactile feedback at more than one part of the swing.

DETAILED DESCRIPTION OF EXEMPLARY EMBODIMENTS

Figure 1A:
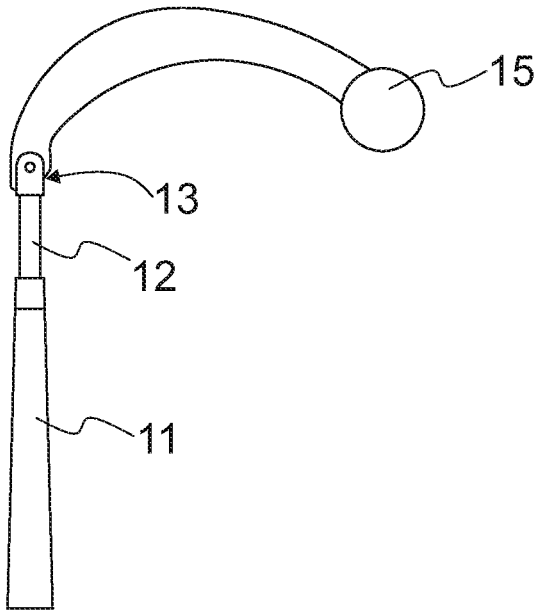
FIG. 1A shows an example golf aide in an open position from the front.
Figure 1B:
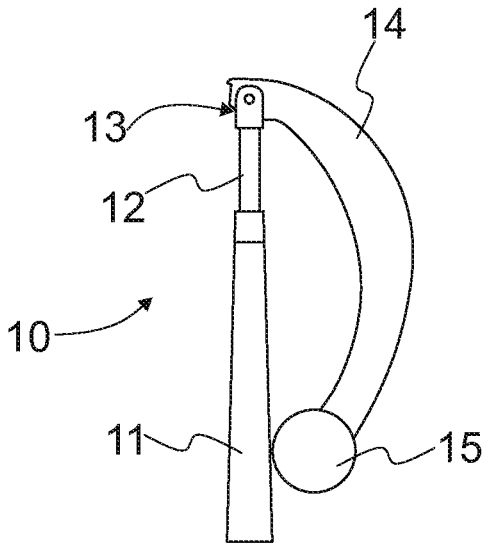
FIG. 1B shows the example golf aide of FIG. 1A in a closed position from the front.

FIGS. 1A and 1B show an example golf aide 10 according to embodiments of the present invention. The golf aide is capable of providing tactile feedback to a user during a golf swing. For example, the golf aide is capable of providing tactile feedback at the apex of the back swing by contacting a user's arm at the proper point and position of the apex. Additionally, the golf aide can provide similar tactile feedback continuously from the apex of a back swing through the slot of the down stroke by, for example, either maintaining contact with the user's arm during the beginning of the down stroke of a one plane swing or by traveling down the user's arm during the beginning of the down stroke of a two plane swing. Still yet, the golf aide can provide tactile feedback on the nape of a users neck or back of the head at the conclusion of the follow through of a golf swing. For example, the tactile feedback for a proper follow through should be at or near the centerline of the back of the head and/or neck of the user.

The golf aide 10 can have a grip 11 such as a golf grip. The grip 11 can be a standard grip for a golf club. Additional or alternative grips can be used as well on the golf aide. For example, the golf grip 11 can be a metallic, plastic or rubber clinoid or rod for example. The golf grip 11 can contain tactile elements, such as bumps or indentations which can, for example, help a user physically position their hands on the grip. The golf grip 11 can also contain visual element, for example to help a user position their hands on the grip in a desired manner.

The golf aide 10 also can have a shaft 12. The shaft 12 can be a typical golf shaft, for example a steel shaft or carbon shaft of either an iron club or a wood club. According to certain examples, the grip can function as a shaft in accordance with the present description. Similarly, the shaft can function as a grip in accordance with the present description. The shaft may also be other than a typical golf club shaft, for example being made of a different material than standard and/or having different dimensions. As will be discussed below, the length of the shaft can also be adjustable according to certain examples.

The golf aide 10 can have an arm 14. Furthermore, the golf aide can have a linking element 13 which is capable of, or does couple the arm 14 to the shaft 12. The linking element 13 can be located at a first end of the arm 14. As shown in FIGS. 1A and 1B, the linking element 13 can be very near to the end of the arm 14 or the linking element 13 can be located directly at the end of the arm or somewhat away from the terminal end, however still being location closer to an end of the arm than the center of the arm's length.

The linking element can be such as a hole and pin arrangement, it can be a fixed coupling means such as a screw, glue or the like and/or it can be an adjustable and/or rotatable coupling means, for example such as having an axel for rotating between more than one position of the arm and shaft. In FIGS. 1A & 1B, the linking element is shown as an ending on the shaft 12 which is coupled to the arm by an axel screw going through a hole in the arm itself, towards the end of the arm, from which the arm can rotate around the axel screw.

At the end of the arm 14 opposite to the linking element 13 is located a tactile indicator 15. The tactile indicator 15 can be located at a distal end of the arm 14, where the distal end is that opposite to the linking element.

Figure 2A:
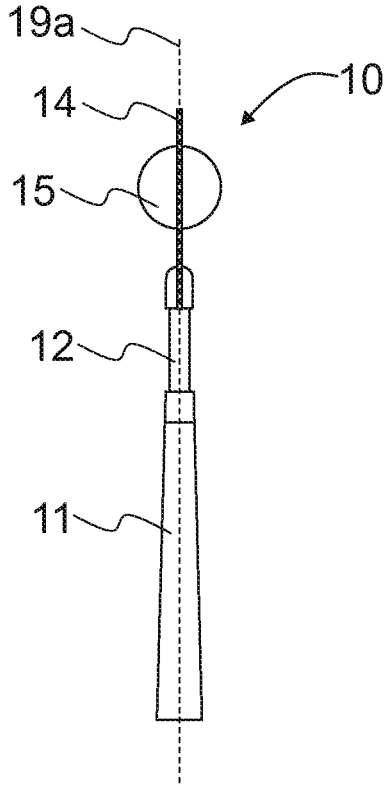
FIG. 2A shows an example golf aide with a straight arm from the side.
Figure 2B:
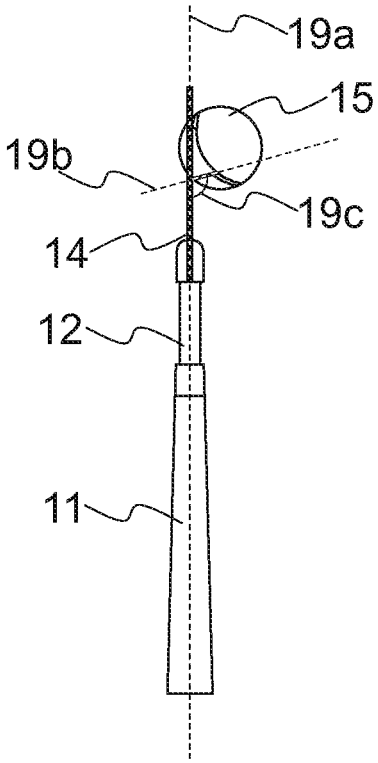
FIG. 2B shows an example golf aide, having a bend in the arm, from the side.
Figure 2C:
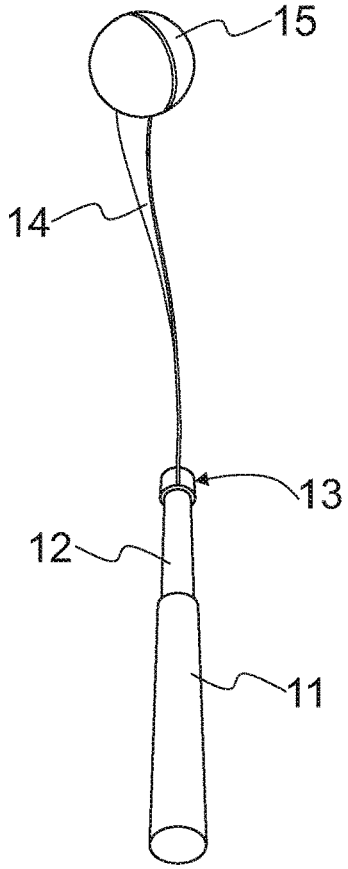
FIG. 2C shows an example golf aide, having a twist in the arm, from the side.

As can be seen in FIGS. 2A, 2B and 2C, the arm 14 can have a relatively narrow thickness and the tactile indicator 15 can be wider than the arm, for example substantially wider than the arm. As can be seen in the figures, the tactile indicator 15 can be arranged with the arm 14 roughly intersecting the center of the tactile indicator 15, such that tactile indicator extends beyond the thickness of the arm 14 on both sides of the arm 14. The arm 14 may also be located off center of the tactile indicator 15 and may only extend beyond the thickness of the arm on one side of the arm.

Still yet, the end of the arm and the tactile indicator may blend such that the end of the arm and the tactile indicator are generally the same width. In such an example golf aide, the arm 14 can be greater in width than the shaft and/or grip. Additionally, in such an example where the tactile indicator is blended with the arm, the tactile indicator portion of the arm can have a width which is thicker than another portion of the arm.

Figure 2D:
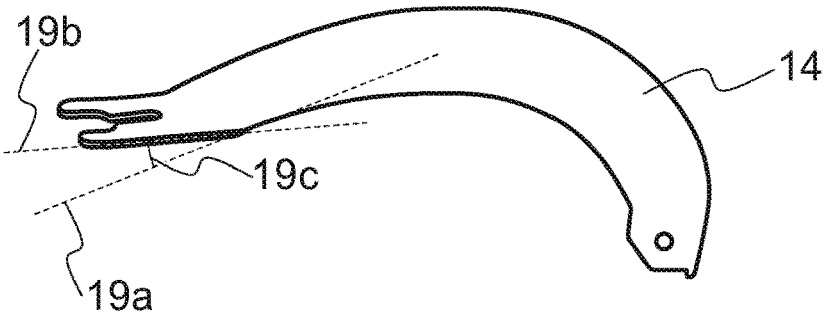
FIG. 2D shows an example arm of a golf aide.

FIG. 2D shows an example arm element having a twist. While the figures show a twist which can be optimized for a right handed golf swing, it is within the scope of the invention as described to optimize the rotation and/or twist in the arm for left handed golf swings. Furthermore, the arm, or a portion thereof can be such that it can be adapted for either right handed or left handed use. For example, the ends of the arm 14 can be such that the arm can be arranged in a first configuration with a first end connected to the shaft in a right handed configuration and where the arm can be arranged in a second configuration with a second end, different from the first, connected to the shaft in a left handed configuration. Still yet, there can be a system with one shaft and two or more separate arms, one for right handed configurations and another for left handed configurations.

As shown in the figures, the tactile indicator is a ball, or spherical shape. The tactile indicator can have a number of different shapes including cylindrical, cubic or another organic shape. The tactile indicator is to provide the tactile feedback to the user during a golf swing. The tactile feedback should be pressure and/or friction from the tactile indicator at a desired spot on the user's arm. For examples where the tactile feedback should not be unpleasant, the tactile indicator should not have an overly abrasive surface or shape. The convex curve of a sphere provides an exemplary tactile feedback to a user.

The tactile feedback of from the tactile indicator could also be such that it is pleasant when contacting the user in a correct manner, and somewhat less pleasant when contacting a user in an incorrect manner. For example, a correct manner can be contacting the user's arm in towards the center of the tactile feedback surface in which case that portion can be smooth while away from the center could be rough or contain one or more edges. It is also conceived that the tactile indicator could provide other than pressure/friction feedback, such as a small electric or static shock. Still yet, the tactile indication may contain one or more sensors, such as a pressure sensor and/or inertia sensor.

Figure 3A:
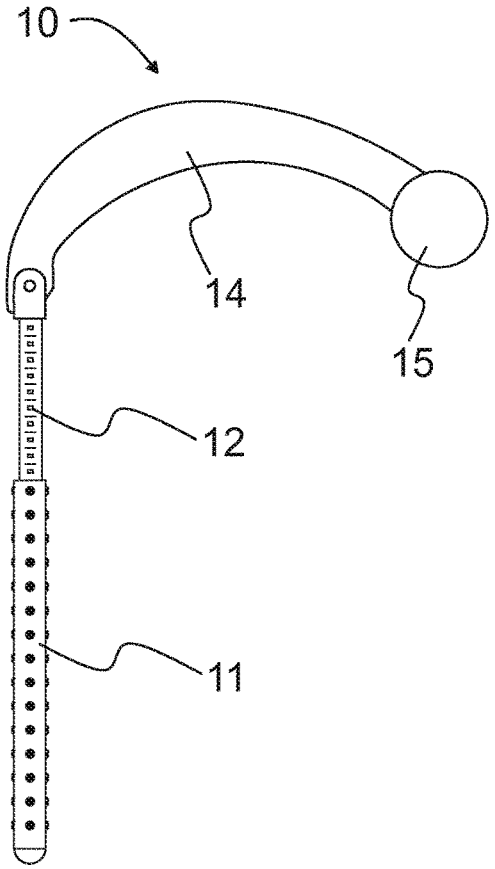
FIG. 3A shows an example golf aide in a an open position with a fully extended shaft.
Figure 3B:
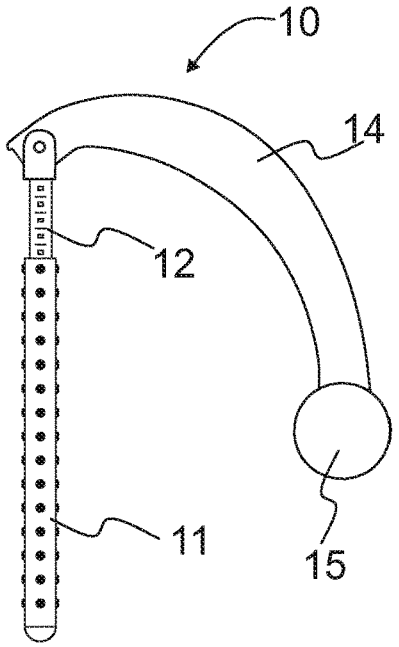
FIG. 3B shows the example golf aide of FIG. 3A in a partially open position with a partially extended shaft.
Figure 3C:
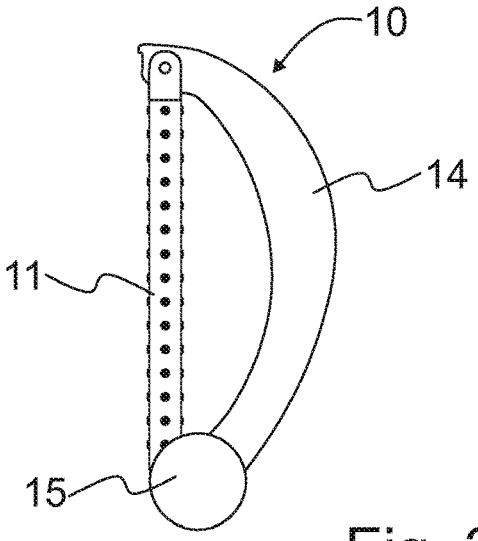
FIG. 3C shows the example golf aide of FIGS. 3A & 3B in a closed position with a fully collapsed shaft.

The shaft 12, arm 14 and tactile indicator 15 can be fixedly arranged in one or more position. For example, FIG. 1A shows them in a first, open position and FIG. 1B shows them in a second, closed position. FIGS. 3A-C show an arrangement in the open and closed positions as well as a third, partially open position, See FIGS. 3A, 3C and 3B respectively. According to certain examples, the shaft, arm and tactile indicator can also be fixed in a single, open position.

In, for example, an open position, the shaft, arm and tactile indicator can be arranged such that the distance and angle between the grip and the tactile indicator is equivalent to a predetermined target distance and angle. The predetermined target distance and angle can be that which is between a user's hands and a lateral upper arm portion of an inside arm of a user during a particular portion of a golf swing, e.g. during a backswing of a golf stroke, at an apex of a backswing of a golf stroke, or in the slot of the downswing of a golf stroke.

Figure 5A:
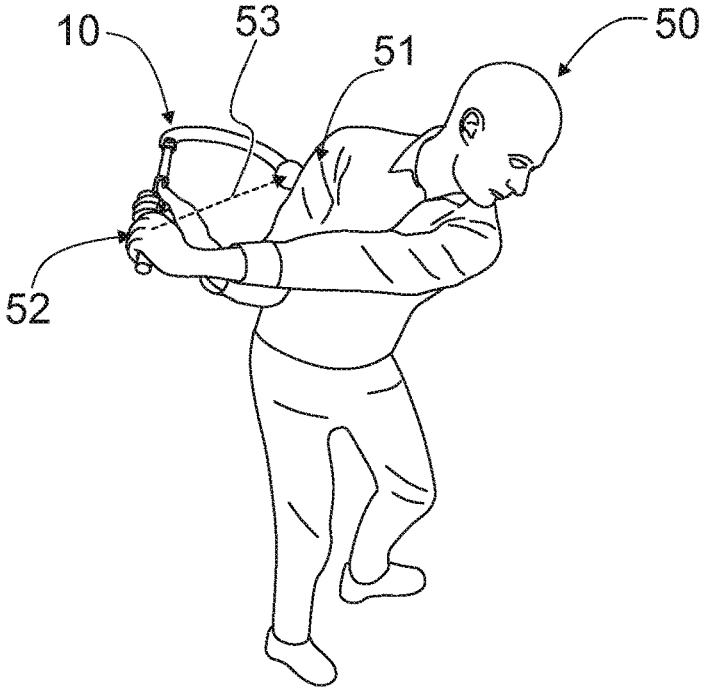
FIG. 5A shows a user with an example golf aide in use at the apex of a back swing of a one plane golf swing.
Figure 5B:
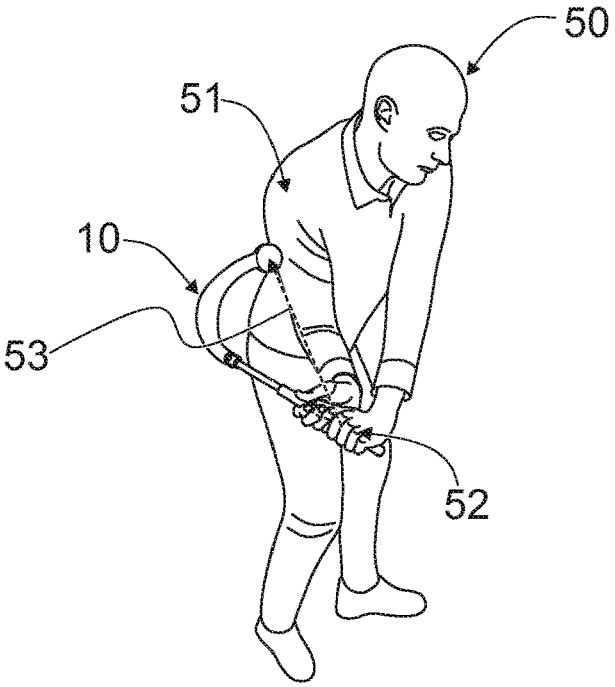
FIG. 5B shows the user of FIG. 5A in the slot during the down swing of a one plane golf swing.

FIGS. 5A and 5B show an example of a user holding the golf aide during a golf stroke. FIG. 5A shows the user at the apex of a backswing and FIG. 5B shows the user in the slot of the downswing. By, the distance and angle between the grip and tactile indicator, it is meant from a point which is where, or in the center of where on the grip a user is to hold the club in their hands during a golf stroke and the distal end of the tactile indicator at the end of the arm. Similarly, the predetermined target distance and angle between the hands and lateral upper arm portion is from the center of the hands or from the same point on the grip as described above to the outer portion of the user's upper arm.

The distance between the two points on the golf aide can be adjusted and/or selected by varying the length of the grip and/or shaft, as well as the angle between the arm and the grip and/or shaft. The distance between the two points can be based on the arm length of the user. For example, FIGS. 3A-3C show the shaft 12 being extended from the grip 11 at three different lengths, where FIG. 3C shows the shaft as not being extended at all. Moreover, the distances discussed herein are explained in more detail below with regards the description of examples of FIGS. 5A and 5B.

The arm 14 can be curved, as shown in the frontal view of FIGS. 1A and 1B. For example, the arm can be curved from the linking element 13 to the tactile indicator 15, or curved for only a portion thereof. Moreover, the curve can be in a single plane, as shown in FIG. 2A, i.e. the golf aide 10 of FIG. 1A having a arm 14 curved in the plane of the grip/shaft 19*a*.

The arm may also include a bend, for example near the distal end of the arm with the tactile indicator. Such an example is shown in FIG. 2B. The bend can be at any point in the arm, can be a product of the linking element and how the arm is linked to the shaft, and/or can be a product of how the tactile indicator 15 is coupled to the distal end of the arm 14. FIG. 2B shows that a plane 19*b* bisecting the tactile indicator, which can also be in line with the distal end of the arm, is separated from the plane 19*a* of the grip/shaft by an angle 19*c*. The angle 19*c* can be between 15-60°, in particular, between 30-50°, more particularly between 40° or 45° to 45° or 50°.

The arm may also include a twist or a partial twist, for example, starting at or towards the end of the arm connected to the linking element and having the twist extend towards and/or to the tactile indicator, as shown in FIG. 2C. Similar to the arm including a bend, there can be a plane 19*b* bisecting the tactile indicator, which can also be in line with the distal end of the arm, which can be separated from the plane 19*a* of the grip/shaft by an angle 19*c*. The angle 19*c* can be between 15-60°, in particular, between 30-50°, more particularly between 40° or 45° to 45° or 50°.

The tactile indicator 15 can be capable of rotation. The tactile indicator can be able to rotate, for example, around an axis which is perpendicular to the arm. An example structure will be described with regards to FIG. 4 below. Moreover, as discussed above, the axis of rotation of the tactile indicator can be in line with a plane of the grip/shaft, perpendicular thereto, perpendicular to the plane of the arm, or offset from either plane by an angle between 15-60°, in particular, between 30-50°, more particularly between 40° or 45° to 45° or 50°.

The linking element, or a portion thereof, can be capable of fixedly arranging the shaft and arm in more than one position. According to certain examples, fixedly arranging includes that in at least one position, e.g. an open position, the shaft and/or grip and arm can be locked with respect to each other. Furthermore, in between two or more positions where the position of the shaft and/or grip and arm are locked, they can be freely located in on or more positions. Each position can allow and/or create a different angle between the shaft and the tactile indicator. Additionally, in one or more position, or in all positions, the rotation of the shaft can be locked. FIGS. 3A-3C show three different example positions.

As discussed above, the golf aide can include a shaft extension mechanism. The shaft extension mechanism may be any mechanical or electromechanical mechanism capable of changing the distance between a point on the shaft and/or grip and a point on the tactile indicator. An example can be seen in FIGS. 3A-3C where the shaft 12 includes markings for indicating the distance of extension. In FIG. 3C the shaft is fully collapsed within the grip and in FIGS. 3A and 3B it is exposed at varying length.

An Example shaft extension mechanism can include a threaded portion on the shaft and a corresponding threaded collar. The threaded collar can then adjust the amount of the shaft which is exposed. The position of the linking element on the shaft can also be adjustable to change the effective length of the shaft, e.g. the distance between an end of the grip and the linking element.

In an example such as shown in FIGS. 3A-3C, when the arm and shaft are in a first position, such as an open position in FIG. 3A, the shaft and grip can be locked, in relation to each other, e.g. in the open position the shaft is not easily extendable. Similarly, in a closed position in FIG. 3C, the shaft and grip can be locked, in relation to each other, e.g. in the closed position the shaft is not easily extendable. In either locked positions or both the rotation of the shaft with respect to the grip can also be locked. In another position, such as a partially open position as shown in FIG. 3B, the shaft and grip can not be locked, e.g. the shaft can be easily extended or retracted from the grip. The rotation of the shaft with respect to the grip may be locked in such a partially open position or it may be adjustable.

Figure 4:
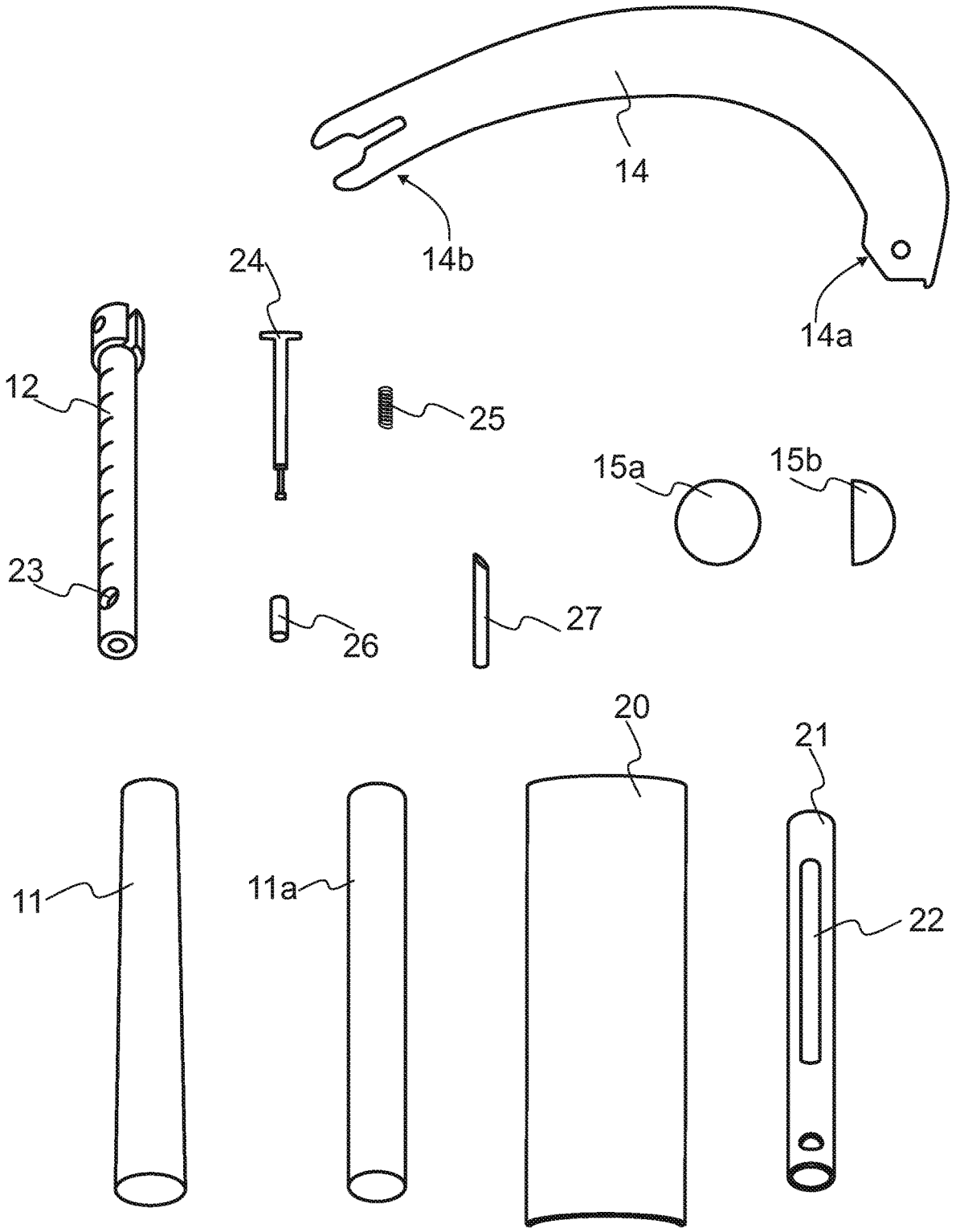
FIG. 4 shows an exploded view of the parts of an example golf aide with extendable shaft.

FIG. 4 shows an example, exploded construction of a golf aide as shown in FIGS. 3A-3C. The golf aide includes the grip 11. The golf aide can also include a grip housing 11*a*. A grip 11 may be sufficient to act as a grip housing 11*a* or they may be separate parts. There may also be an pad insert 20. The pad insert can be a soft material, such as rubber, fabric or plastic. The pad insert can be to insure a snug fit of the components within a grip/shaft assembly. Additionally, there can be a female locking insert 21 with an opening 22. When assembled, the grip housing 11*a* is inserted into the grip 11, the pad insert 20 is inserted into the grip housing 11*a* and the female locking insert 21 is inserted into the grip housing 11*a* and frictionally held in place by the pad insert 20. However, the function of any or all of these pieces can be combined into fewer discrete parts.

The shaft 12 can include a hollow center where a see-saw pin 24 can be inserted. The see-saw pin can have a crossed shape with a flat head and pin extending perpendicularly therefrom. The bottom of the pin, opposite the head, can be angled. The bottom of the pin 24 can also be flat or other shaped. There may also be a pin extension 27 having, for example, an angled end which is inserted into the hollow opening of the shaft and in contact with the see-saw pin 24. The shaft 12 can have an opening 23 from which a tab 26 can optionally protrude. The tab 26 can have an angled portion which corresponds to the angle of either the see-saw pin bottom or the pin extension. Furthermore, the shaft assembly can include a spring located under one or both ends of the flat head of the see-saw pin 24. The function of any or all of these pieces can be combined into fewer discrete parts. In operation, the shaft assembly would be inserted within the female locking insert, or optionally just within a grip or grip housing.

The arm 14 can have a first end 14*a* with a geometry as shown in FIG. 4 or a functional equivalent thereto, as will be described. During operation, the arm 14 is rotationally coupled, via the linking element, to the shaft. The geometry of the first end 14*a* can be such that in a closed position there is pressure on the top of the see-saw pin 24 housed within the shaft 12. As such, the see-saw pin 24 is depressed and the angled bottom, or the angled bottom of a pin extender 27, pushes the tab generally linearly out of the opening 23, and for example, out of the opening 21 of the female locking insert 21 to frictionally interact with the pad insert 20 of the grip assembly. Thus, the friction of the tab 26 against an internal portion of the grip assembly will effectively lock the position of the shaft with respect to the grip. Additionally, the presence of the opening in the female locking insert will lock the rotation of the shaft/shaft assembly with regards to the grip/grip assembly.

The geometry of the first end 14*a* can also be such that in an open position, there is pressure on the top of the see-saw pin and the same locking action occurs. However, the geometry of the first end 14*a* can be such that in a partially open position, there is no or little pressure on the top of the see-saw pin. As such, the spring located under the head extensions of the pin can push the see-saw pin up, releasing pressure on the tab such that it can retract through at least a portion of the opening 22 of the female locking insert 22 so as to allow extension of the shaft/shaft assembly or retraction of the shaft with respect to the grip/grip assembly.

The same principle can be applied through different means. For example, there can be one or more discrete locking or locked positions where different internal mechanisms are used to lock shaft and grip with each other. Similarly, the operation of the mechanism described can be reversed so that pressure on a pin within the shaft can un-lock the shaft/shaft assembly and grip/grip assembly. Numerous variations can be conceived by those of ordinary skill in the art which do not depart from the scope of the present invention.

The distal end 14*b* of the arm 14 can have a geometry or opening which is capable of receiving one or more portions of the tactile indicator 15. In the example of FIG. 4, the tactile indicator is a sphere with a first half 15*a* and a second half 15*b*. The two parts of the tactile indicator can be combined around the distal end 14*b* of the arm 14. Additionally, the two portions can be combined by an axel which allows the tactile indicator to rotate in an axis generally perpendicular to the plane of the distal end of the arm.

The shaft and the grip can be arranged linearly in a first plane. The arm can have a thickness in the plane of the shaft and grip. The arm can have a first indicator on one side of the thickness and a second indicator, different from the first, on the opposite side of the thickness. Such indicators can be a tactile indicators as shown in FIG. 4 with halves 15*a* and 15*b* on each side of the arm. It is noted that while the term half is used, the two halves can be portions and not symmetrical or identical, for example, one half can be larger or smaller than the other.

Additionally, there can be one or more visual indicators on one or more sides of the arm. As an example, one side of the arm can have a first color and the other side can have another, contrasting color. When the golf aide is swung, the user can then see at the perceived point of contact with a ball one of the two colors.

Through this visual feedback they can tell if the golf aide is properly rotated at impact or improperly rotated.

The predetermined target distance and angle between the hands and lateral upper arm portion of a user can be selectable before use of the golf aide. The linking element and/or a shaft extension mechanism can be capable of fixedly arranging the same distance and angle between the grip, arm and tactile indicator. Example use of the golf aid is discussed below.

FIGS. 5A and 5B show an example of a user 50 with the golf aide 10. The grip 11 of the golf aide 10 is positioned in the hands of the user just as a normal golf club would be held. The grip 11 can be a standard golf grip. Additionally, there can be markings on the grip, for example indicating where one or both of the thumbs should be located during a proper grip of the club. Additional markings, such as a center line from the shaft and/or alignment lines, e.g. where the shaft/grip should be pointing at when addressing the ball and/or during the swing.

FIG. 5A shows an example of a user at the apex of the backswing of a one plane golf swing. FIG. 5B shows an example of a user in the slot of the downswing of a one plane golf swing. As will be discussed below, the present golf aide can be used with both a one plane swing and a two plane swing.

The golf aide 10, in the open position for use as shown, has the arm 14 extending away from the grip 11 and shaft 12 with the tactile indicator 15 located at the distal end of the arm 14 opposite the end of the arm 14 coupled to the shaft 12. The distance 53 and angle between the portion of the grip 11 to be held by the hands 52 of the user 50 and the tactile indicator 15 is equivalent to the distance and angle between the hands of the user 52 and the lateral portion of the upper arm 51 of the inside arm of the user during a backswing of a golf stroke. For example, in the picture the user is right handed and the inside arm of the backswing is the right arm.

During use of the golf aide, the user will hold the grip of the golf aide as a normal club in an address position, e.g. as if to hit an imaginary golf ball. The grip, arm and tactile indicator should all be in line with each other extending from the hands towards the ground. The user should then proceed with the back swing as normal, both rotating their wrists and breaking their inside elbow of the swing. At the climax of the target backswing, the tactile indicator will make contact with the lateral portion of the upper arm 51 of the user 50.

By lateral portion of the upper arm, it is meant the side of the upper arm when considering a person standing straight, as opposed to the front of the arm. Stated another way, for a one plane swing, the lateral portion of the upper arm 51 of the user is near or nearer to the intersection of the deltoid, triceps brachii and biceps brachii as opposed to near the center of either the biceps brachii or triceps brachii. The lateral portion of the upper arm of a two plane swing would be more completely on the deltoid.

During a desired, target golf back swing, the tactile indicator will make light to moderate contact with the lateral portion of the upper arm. A common error in user's backswings is an over swing, where the hands travel further than intended up and behind the user's head. The contact between the tactile indicator and the users upper arm provides immediate tactile feedback as to the proper length of the backswing and limits or prevents over backswing, i.e. once the tactile indicator contacts the user's body, regardless of where the tactile indicator contacts the body the user is instantly alerted that the backswing should no longer be continued.

A second common error in a user's backswing is that at the climax of the backswing, the user's wrists and elbows are not in the proper/optimal position. During a typical swing, a golf instructor can easily look at the position and orientation of the head of a golf club in a backswing and provide feedback to the user if the wrists and elbows are in the proper position based on their view of the club head. However, it is impossible for the user to see the head position and orientation during the back swing as the club head should be positioned behind and above the user's head.

Due to the distance and angle between the golf grip, e.g. the portion of the golf grip or the center of the portion of the golf grip held in the hands of the user, and the tactile indicator, at the correct climax of the backswing the tactile indicator will touch the correct portion of the lateral portion of the upper arm of the user, e.g. near or at the intersection of the deltoid, triceps brachii and/or biceps brachii of the user for a one plane swing. Essentially, the golf aide takes the visual cues of the head of a normal golf club during a backswing and coverts those visual cues to tactile cues with the tactile indicator.

As such, if the wrists are over rotated in an "open club face position", for example, the tactile indicator may fall towards the back of the upper arm, e.g. more on the triceps brachii than intended during the target backswing. If the wrists are under rotated in a "closed club face position", for example, the tactile indicator may fall towards the front of the upper arm, more on the biceps brachii than intended during the target backswing. Similarly, if the angle between user's forearm and upper arm is incorrect, the tactile indicator may fall higher or lower on the upper arm than intended, e.g. higher or lower than intended on the lateral portion of the upper arm, e.g. towards the center of the upper arm opposed to towards the intersection of the deltoid, triceps brachii and biceps brachii or more towards the center of the deltoid.

For each user, the optimal position of the tactile indicator at the climax of the golf swing can be determined and indicated for the user. Then, in every swing it is possible for the user to determine how if they have achieved the target backswing or if they have missed the target location of the climax of the backswing. Additionally, the tactile indicator can be used by the user to move the position of the wrists and arms/elbows after a practice backswing which is improper to bring the position and orientation of the user's backswing to the correct position and orientation by feel, something that would not be possible with a regular golf club as the user would need to twist their head to see the face of the golf club which would necessarily change the position and orientation of the original backswing.

A third common error in a user's swing is that once they leave the climax of the backswing to impact the ball, the user "pushes" their hands away from their body on the downswing causing the club face to open prior to contacting the ball and resulting in an slice. The "push" of the hands often occurs at the top of the downswing, before the slot as shown in FIG. 5B, by improperly moving the inner elbow away from the body early.

As shown in FIG. 5*b*, the golf aide can also be used to provide tactile feedback to the user during the initial portion of the downswing through the slot. During a proper, target one plane downswing, the tactile indicator will remain in place from the apex through until the slot. During a proper, target two plane downswing, the tactile indicator will glide down the upper arm for several centimeters before coming away from the upper arm of the user. If the user feels the tactile indicator break from the upper arm at the beginning of the golf swing the user is alerted that their hands are likely moving away from their body early which will result in an open club face at the ball.

In order to facilitate the movement of the tactile indicator down the upper arm of the user, the tactile indicator may be rotatable. The tactile indicator may be spherical and capable of rotation about more than one axis. The tactile indicator may also be spherical, cylindrical or of other shape and only rotateable around a single axis. The single axis can be perpendicular to the arm of the golf aide such that the tactile indicator will only travel smoothly in a motion straight down the user's arm during a target golf swing. If the movement of the tactile indicator is not perpendicular to the axis of rotation of the tactile indicator then the user should experience friction, indicating that additional and undesired rotation is occurring during the user's downswing.

The golf aide can be used to give other, similar feedback during the swing. For example, the tactile indicator can be positioned at a desired location at the end of the follow through so that a user can receive tactile feedback at the end of the swing, for example on the back of the head or nape of the neck. The golf aide may have additional markings which provide information to the user and/or provide additional means of feedback for the user. For example, if the arm of the golf aide has a noticeable thickness, for example in the plane of the grip and shaft as shown in the figures, in particular in FIGS. 1A and 1B, then one side of the arm can be one color and the opposite side can be a contrasting color, e.g. visual indicators. With the use of these two colors, the user will be able to receive a visual cue at the moment of desired impact with a ball at the cross over between the downswing and follow through. For example, if the user doesn't see any particular color then the club should be at a neutral position at the moment of desired impact. However, if the user glimpses one of the two contrasting colors, the user is visually indicated that the club face would be open or closed, i.e. that the grip and shaft are under or over rotated compared to the target neutral orientation.

It is to be understood that the examples of the invention disclosed are not limited to the particular structures, process steps, or materials disclosed herein, but are extended to equivalents thereof as would be recognized by those ordinarily skilled in the relevant arts. It should also be understood that terminology employed herein is used for the purpose of describing particular examples only and is not intended to be limiting.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary. In addition, various examples of the present invention may be referred to herein along with alternatives for the various components thereof. It is understood that such examples and alternatives are not to be construed as de facto equivalents of one another, but are to be considered as separate and autonomous representations of the present invention.

Furthermore, the described features, structures, or characteristics may be combined in any suitable manner. In the preceding description, numerous specific details are provided, such as examples of lengths, widths, shapes, etc., to provide a thorough understanding of examples of the invention. One skilled in the relevant art will recognize, however, that the invention can be practiced without one or more of the specific details, or with other methods, components, materials, etc. In other instances, well-known structures, materials, or operations are not shown or described in detail to avoid obscuring aspects of the invention.

While the forgoing examples are illustrative of the principles of the present invention in one or more particular applications, it will be apparent to those of ordinary skill in the art that numerous modifications in form, usage and details of implementation can be made without the exercise of inventive faculty, and without departing from the principles and concepts of the invention. Accordingly, it is not intended that the invention be limited, except as by the claims set forth below.

10—golf aide
11—grip
11*a*—grip housing
12—shaft
13—linking element
14—arm
14*a*—first end of the arm 14
14*b*—distal end of the arm 14
15—tactile indicator
15*a*—first half of tactile indicator
15*b*—second half of tactile indicator
19*a*—plane of the grip/shaft
19*b*—plane of the tactile indicator/distal end of the arm
19*c*—angle between planes 19*a* & 19*b*
20—pad insert
21—female locking insert
22—opening in the female locking insert 21
23—opening in the shaft 12
24—see-saw pin
25—spring
26—tab
27—pin extension
50—user
51—lateral portion of the upper arm
52—point which is approx. center of hands and of grip where hands will be gripped
53—distance between point 52 and tactile indicator The invention clamed is:

1. A golf aide comprising:

a shaft with a golf grip:

an arm having at least a partially twisted shape with bending, angles substantially less than 90° and having a linking element coupling the arm to the shaft at a first end of the arm to provide a rotational movement of the arm around a corresponding axis which is substantially perpendicular to the shaft the rotational movement of the arm providing an open position of the arm relative to the shaft and a partially open position of the arm relative to the shaft;

a tactile indicator configured to provide a tactile feedback to a user, wherein the tactile indicator is arranged at a distal end of the arm opposite the linking element, said tactile indicator having a width greater than a width of the arm, wherein the shaft, the arm and the tactile indicator are configured to be fixedly arranged by moving the arm from the partially open position to the open position, and using a. corresponding length of the shaft to provide a distance and a corresponding angle being defined between a portion of the golf grip to be gripped during a golf stroke and the tactile indicator which are equivalent to, respectively, a predetermined target distance and a further angle being defined between hands and a lateral upper arm portion of an inside arm of a user at an apex of a backswing of the golf stroke, and wherein said tactile indicator is capable of rotating around an axis to facilitate the movement of the tactile indicator down the upper arm of the user during a downswing of the golf stroke.

2. The golf aide according to claim 1, wherein the tactile indicator at the distal end of the arm is twisted off from a plane of the shaft and the grip by between 15-60°, or in particular, between 30-50°.

3. The golf aide according to claim 1, wherein the linking element is capable of fixedly arranging the shaft and the arm in more than one position, wherein each position allows a different angle between the shaft and the tactile indicator.

4. The golf aide according to claim 1, further comprising a shaft extension mechanism capable of changing the distance between the golf grip and the tactile indicator.

5. The golf aide according to claim 4, Wherein the shaft extension mechanism includes a threaded portion of the shaft and a corresponding threaded collar.

6. The golf aide according to claim 1, wherein when the arm and the shaft are in a first position, the length of the shaft is adjustable, and when the arm and the shaft are in a second position, the position and rotation of the shaft is locked.

7. The golf aide according to claim 1, wherein the arm is curved from the linking element to the tactile indicator.

8. The golf aide according to claim 1, wherein the tactile indicator is spherical or cylindrical.

9. The golf aide according to claim 1, Wherein a rotation of said tactile indicator is around an axis perpendicular to the arm.

10. The golf aide according to claim 1, wherein a rotation of said tactile indicator around an axis which is offset from a plane of the arm by an angle between 15-60°, or in particular, between 30-50°.

11. The golf aide according to claim 1, wherein the linking element enables the shaft, the arm and the tactile indicator to be fixedly arranged in at least one position where corresponding angle and rotation between the arm and the. shaft are locked.

12. The golf aide according to claim 1, wherein the shaft and the grip are arranged linearly in a first plane, and wherein the arm has a thickness in the first plane of the shaft and the grip and corresponding first and second surfaces separated by the thickness, wherein the arm has a first indicator on the first surface and a second indicator, different from the first, on the second surface.

13. The golf aide according to claim 1, wherein the shaft and the grip are arranged linearly in a first plane, and wherein the arm has a thickness in the first plane of the shaft and grip, and wherein the tactile indicator is arranged at the distal end of the arm such that the tactile indicator extends beyond the thickness of the arm in both directions perpendicular to the first plane of the shaft and the grip.

14. The golf aide according to claim 1, wherein the predetermined target distance and the further angle between the hands and the lateral upper arm portion of the inside arm of the user are selectable before using the golf aide and wherein one or more of the linking element and a shaft extension mechanism are capable of fixedly arranging the distance and the corresponding angle.

15. The golf aide according to claim 1, wherein the shaft being extendable from the golf grip for adjusting a length of an extended portion of the shaft, the shaft comprising markings for indicating an extended distance from the golf grip.

16. The golf aide according to claim 15, wherein, when the arm is in the open position relative to the shaft, the length of the extended portion of the shaft is fixed, and when the arm is in the partially open position relative to the shaft, the length of the extended portion of the shaft is adjustable.

17. The golf aide according to claim 1, wherein the shaft has a non-extendable selected length to provide said distance.

18. The golf aide according to claim 1, wherein the tactile indicator has a spherical shape comprising two parts.

19. The golf aide according to claim 1, wherein a position of the linking element on the shaft is further adjustable to provide said distance.

20. A golf aide comprising:

a shaft with a golf grip, the shaft being extendable from the golf grip for adjusting a length of the shaft and comprising markings for indicating an extended distance from the golf grip, an arm having a linking element coupling the arm to the shaft at a first end of the arm to provide a rotational movement of the arm around a corresponding axis which is substantially perpendicular to the shaft, wherein, when the arm is in an open position relative to the shaft, the length of the shaft is fixed, and when the arm is in a partially open position relative to the shaft, the length of the shaft is adjustable, a tactile indicator configured to provide a tactile feedback to a user, wherein the tactile indicator is arranged at a distal end of the arm opposite the linking element, said tactile indicator having a width greater than a width of the arm, wherein the shaft, the arm and the tactile indicator are configured to be fixedly arranged by adjusting the length of the shaft when the arm is in the partially open position and subsequently fixing the adjusted length of the shaft via corresponding movement of the arm from the partially open position to the open position to provide a distance and a corresponding angle being defined between a portion of the golf grip to be gripped during a golf stroke and the tactile indicator which are equivalent to, respectively, a predetermined target distance and a further angle being defined between hands and a lateral upper arm portion of an inside arm of a user at an apex of a backswing of the golf stroke, and wherein said tactile indicator is capable of rotating around an axis to facilitate the movement of the tactile indicator down the upper arm of the user during a downswing of the golf stroke.

* * * * *